United States Patent [19]

Lundbald et al.

[11] 4,066,253

[45] Jan. 3, 1978

[54] APPARATUS FOR DISPENSING BANKNOTES, TICKETS OR THE LIKE

[75] Inventors: Leif Jorgen I. Lundbald, Huddinge; Jan Olof Ek, Alvsjo, both of Sweden

[73] Assignee: Inter Innovation AB, Stockholm, Sweden

[21] Appl. No.: 746,029

[22] Filed: Nov. 30, 1976

[30] Foreign Application Priority Data

Dec. 2, 1975 Sweden ..... 7513557

[51] Int. Cl.[2] ..... B65H 5/22

[52] U.S. Cl. ..... 271/4; 194/4 R; 271/9; 271/259; 271/263; 271/264

[58] Field of Search ..... 271/4, 9, 258, 259, 271/262, 263, 264, 265, 64; 194/4 R, 4 C, 4 E

[56] References Cited

U.S. PATENT DOCUMENTS

| | | | |
|---|---|---|---|
| 3,378,251 | 4/1968 | Donabin | 271/9 X |
| 3,608,690 | 9/1971 | Morrow | 194/4 C |
| 3,790,161 | 2/1974 | Ericsson | 271/9 X |
| 3,795,395 | 3/1974 | Ransom | 271/4 |
| 3,954,260 | 5/1976 | Morello | 271/263 X |

*Primary Examiner*—Richard A. Schacher
*Attorney, Agent, or Firm*—Sughrue, Rothwell, Mion, Zinn and Macpeak

[57] ABSTRACT

Separate feeders are provided in line above and overlying a plurality of longitudinally aligned magazines with the feeders removing banknotes from their magazines and feeding the banknotes commonly through the aligned feeders towards a junction common to all magazines for discharging banknotes through a dispensing aperture of a banknote discharging apparatus.

8 Claims, 2 Drawing Figures

APPARATUS FOR DISPENSING BANKNOTES, TICKETS OR THE LIKE

The present invention relates to an apparatus for discharging banknotes, for example, to a dispensing aperture exteriorily accessible to customers. The apparatus is of the kind comprising a number or magazines, feeding means for feeding banknotes from the magazines to the dispensing aperture, and detector and counter means for detecting notes possibly fed out twofold and counting dispensed notes.

In a special embodiment the invention relates to an apparatus for feeding notes of different denominations to the dispensing aperture.

The object of the invention is to provide a dispensing apparatus which can be easily extended with more magazines, which can be easily altered for notes of other denominations, which is quick and reliable in operation and because of its rational construction can be manufactured for a reasonable price.

The characterizing features of a dispensing apparatus according to the invention, for banknotes, is apparent from the appended patent claims.

Figure 2:
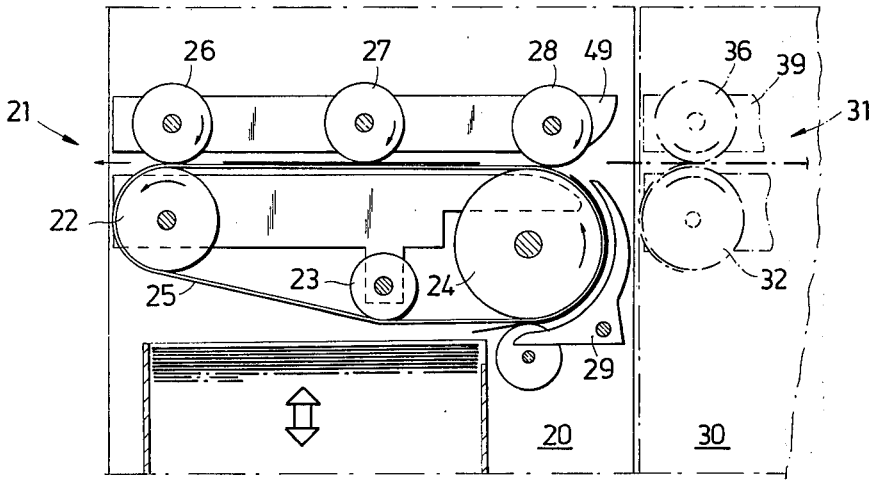
Figure 1:
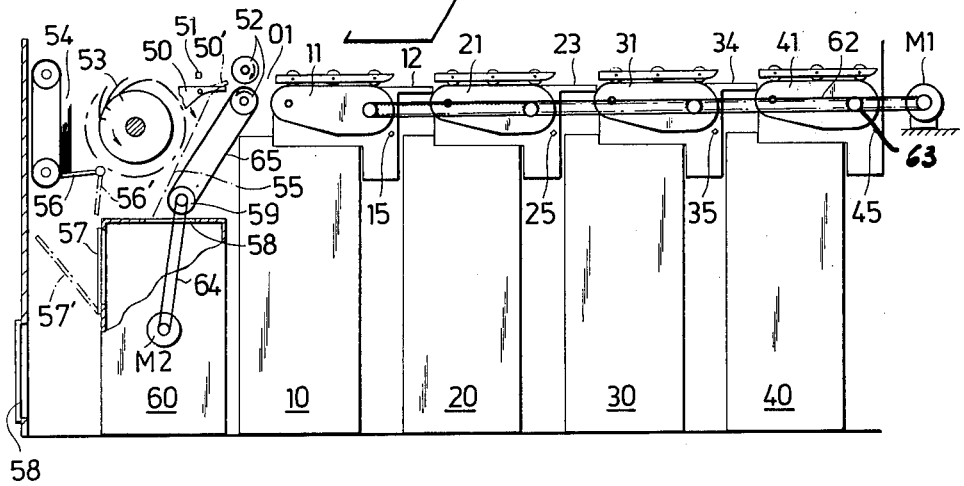

The invention will now be more closely described in conjunction with the appended drawing, on which FIG. 1 shows in a simplified way an embodiment according to the invention, and FIG. 2 shows the upper part of a magazine.

The apparatus comprises four magazines intended for banknotes of different denominations, for example, magazine 10 for 5-kronor notes, magazine 20 for 10-kronor notes, magazine 30 for 50-kronor notes and magazine 40 for 100-kronor notes. The magazine 10 has a separate feeder 11 which is incorporated in series in and forms a portion of feeding means 41–54 for feeding notes from the magazines 10–40 to a dispensing aperture 58. In the same way, the magazine 20 has a separate feeder 21, the magazine 30 a separate feeder 31 and the magazine 40 a separate feeder 41. The feeders 11, 21, 31 and 41 are thus incorporated in said feeding means, forming together with feeder portions 12, 23 and 34 a first part of the feeding means from the magazine 40 to a common junction 01 for all the magazines 10–40. The said first part of the feeding means, namely 11-12-21-23-31-34-41, has for its operation a first driving means which is separate from other driving means for operating the remaining part of the feeding means from the common junction 01 to a collecting room 54, common to the banknotes, and further to the dispensing aperture 58. This first driving means consists, for example, of a driving motor M1, which via a chain or a belt 62 drives the wheels in the feeding parts, e.g. the wheel 24 in the feeder part 31 (FIG. 2). Each such driven wheel has, in the embodiment shown in FIG. 2, a toothed wheel 63 coacting with the endless chain or belt 62. Even if only one wheel 24 is shown to be driven, it is obvious that remaining wheels or rollers 22–24 and 26, 27 may be driven by the motor M1. The second driving means consists of a motor M2 which, via an endless chain 64 or the like, drives wheels or rollers 52, 59 in a feeder. In FIG. 1 there is shown the wheel 59 driving the lower of two coacting wheels 52, 52 via a chain or belt 65.

At each magazine there are arranged detector and counter means, denoted 15, 25, 35 and 45, respectively. These means are intended for the detection of notes which have possibly been discharged twofold, and for counting discharged notes, and are arranged to stop said first driving means if notes are discharged twofold, while said second driving means continues to drive the remaining part of the feeding means. The separate feeders are so made that when the desired number or notes from a magazine has been fed out, e.g. the magazine 10, then the discharge of notes from the magazine 10 ceases because contact ceases between the uppermost note in the magazine and the separate feeder 11, but this feeder continues to function, for which reason the feeding means operates continuously and thereby notes from the magazines further away can be fed to the dispensing aperture 58.

In connection with the common junction 01 there is arranged a feeder 52—52 and a control means 50, arranged in a first normal working position to steer notes from the common junction 01 via the feeder 52—52 and a stacker 53, known per se, to the common collecting room 54. It is indicated on the drawing how notes of different denominations are collected in the common collecting room. The control means 50 is further arranged so that in a second position 50', resulting from the detection of a twofold discharge of notes in any of the means 15–45, it steers notes from the common junction 01 to a special magazine 60 intended for collecting rejected notes. The path to this magazine consists of the control means 50', a guiding chute 55 and a feeder 52–59 and leads to an aperture 58 in the magazine 60.

In connection with the common junction 01 and on the other side of the feeder 52—52, there is arranged a counter means 51 for counting notes passing the path between the common junction 01 and the common collecting room 54. This counter means is further arranged to cause feed pulses to the separate feeder of the current magazine, in response to the desired number of notes. It is hereby ensured that even for a case with possible twofold discharge of notes the right number of notes will be fed out from the magazine in question to the common collecting room 54.

The collecting room 54 has a pivotably arranged bottom 56. Between the collecting room 54 and the dispensing aperture there is arranged a control means 57, enabling in a first vertical position the passage of notes from the collecting room 54 to the dispensing aperture 58, and in a second sloping position 57' to forcibly guide notes from the collecting room 54 to the special magazine 60 via an opening in its wall. The coaction between the said elements is that after notes have been collected in the common collecting room 54, the control means 57 is first set in the intended position and the pivotably arranged bottom 56 is thereafter turned into its vertical position 56'.

A customer desiring to obtain 10 5-kronor notes and ten 50-kronor notes must first register his authority to receive money, e.g. by inserting his credit card in a special aperture (not shown on the drawing). Approval of the card is indicated by a green signal lamp, for example, whereon the customer can key in his requirement on a keyboard (not shown). In the case mentioned, the customer depresses a key for the magazine 10 and two keys for the number 10; subsequently he depresses a key for the magazine 30 and two keys for the number 10. He finally presses a START button, whereon ten notes are fed out one by one from the magazine 10 and are collected in the collecting room 54. After the tenth note has left the magazine 10, the mechanical connection between the bundle of notes in the magazine 10 and its separate feeder 11 is broken. No starting inpulse is sent to the magazine 20, but of course to magazine 30, from which ten notes are now fed out one by one in the same way as for magazine 10 until 10 notes have been fed out. These 50-kronor notes are now fed from the magazine 30 via the separate feeders 31, 21, and 11 to the common junction 01 and from here via the feeder 52—52, control means 50 and the stacker 53 to the common collecting room 54, where the 10 5-kronor notes are already collected in a bundle. With the control means 57 in its vertical position, the bottom 56 is then turned anti-clockwise to its vertical position, whereon the collected bundle of 10 5-kronor notes and 10 5-kronor notes is fed in one operation down to the dispensing aperture which is accessible to the customer.

If the variation is now conceived for the case under discussion that a twofold discharge takes place from the magazine 30 after seven 50-kronor notes have been fed out in the correct way, the continuation will be as follows. When the detector means 35 finds the twofold discharge, the mechanical contact between the bundle in the magazine and its feeder is broken and an impulse is given to the first driving means to stop the first part of the feeding means, i.e. all the separate feeders 11-21-31-41, but the remaining part of the feeding means is not actuated, i.e. a 50-kronor note which has reached the common junction 01 is fed to the collecting room 54 where the 10 5-kronor notes and some 50 -kronor notes are already collected. Hereafter an impulse is given to the control means 50 to assume the position 50', whereon the driving means for the separate feeders starts once again. The notes on the path 31-23-21-12-11 are now conveyed via the feeder 52—52, control means 50 in the position 50' and the guiding chute 55 to the magazine 60. After a certain time the control means 50 is turned to its normal position and three impulses are given via the counter means 51 and detector/counter means 35 to the separate feeder 31 to feed out a further three 50-kronor notes. Dispensing to the customer subsequently takes place in the way previously described. If the case should occur, for example, that there is a current failure during feed from a magazine, the following starting-up sequence takes place when current returns. The control means 57 remains in its position 57', the control means 50 is caused to assume its position 50', the bottom 56 is turned to its vertical position, the second driving means is started and the first driving means is started. Hereby, the collecting room 54 as well as the whole of the remaining discharge path is emptied of notes which are collected in the magazine 60. The means 56 and 50 are subsequently returned to their normal positions, whereafter the apparatus starts again from the beginning to comply with the customer's order as keyed-in on the keyboard.

The apparatus can be provided with a further magazine for supplying a receipt for the dispensed amount. This magazine is suitably placed first or last in the row of magazines.

As the simple and compact construction of the apparatus invites the possibility of a large number of notes in a plurality of magazines, it can, from the point of view of security, be suitable to make the magazines with inputs for strong colouring agents, e.g. of the foam type. At the slightest attempt of incorrect handling of the apparatus, these agents can be caused to force their way into the magazines and to dye the notes without loss of time, thereby making them unusable for payment.

In the apparatus hereinbefore described as an example, the magazines are intended for banknotes in different denominations. There is naturally nothing to prevent the magazines being arranged for notes of one and the same denomination, which can be suitable, e.g. in the case where it is desired to set up the apparatus in remote places with less possibilities conditioned thereof for service.

The apparatus now described requires for its function an electronic unit which generates, distributes and receives impulses. It has, however, not been regarded suitable or necessary to burden the description with a detailed account hereof. After the tasks and functions of the different means have been established, it does not seem part of inventive activity to supply the necessary electronics by using available components.

It is possible to make the magazines with the separate feeders so that the said feed portions 12, 23 and 34 can be excluded. Such a modification is apparent from FIG. 2, showing in somewhat greater detail the upper part of the magazine 20 with the feeder part 21, and also indicating the feeder part 31 of the magazine 30. The feeder part 21 has wheels 22, 23, 24 carrying an endless belt 25, and wheels 26, 27, 28 running against the upper face of the belt 25. A lower guide strip 29 with a circular inner surface guides the note fed out by the separate feeder of the magazine round the wheel 24 and inbetween the wheels 24 and 28, there being an upper guide strip 49 to guide the note further between the belt 25 and the wheels 27 and 26 towards the magazine 10 (not shown) on the left, with its separate feeder 11. From the magazine 30 with its feeder 31, on the right and only partly indicated, a note can be conveyed by the coacting wheels 36, 32 to the left into the feeder 21 of the magazine 20, the convex outer surfaces of the guide strips 29 and 49 facing towards the magazine 30 having a guiding function for notes coming from the magazine 30 or the magazine 40.

Many modifications can be conceived, which fall within the scope of the patent claimes. For example, the means 51 can be caused not only to carry out counting and checking functions, but also a twofold discharge check as an extra safety measure. It is possible for twofold discharge checking only to take place in the means 51, in which case the whole bundle of notes is re-fed to the magazine 60. With twofold discharge checking at the means 15-25-35-45 and with a special design of the pivotable control means 50, it is possible, on discovering twofold discharge, e.g. at the means 25, to break the mechanical contact between the bundle in the magazine and its feeder (but not the first part of the feeding means), and at a time determined by the means 51 to turn the guide means 50 to the position 50' so that only the notes discharged twofold are fed between the guide strip 55 and the feeder 52–56 to the magazine 60.

It is suitable to design the means 50, 56 and 57 in such a way that by mechanical or electrical means they are prevented from allowing the passage of notes to the dispensing aperture 58 when withdrawal shall not take place, i.e. they then assume the positions 50', 56' and 57', respectively. When withdrawal is to take place there are thus required special impulses (brought about mechanically or electrically) to bring them into the positions 50, 56 and 57, respectively.

The construction of the apparatus in two main parts, namely a main part with the details to the left of the common junction 01 and a main part with the magazines and the separate feeders arranged in series, has given a product which is easily extended for the required number of notes of possibly different denominations. The modular construction set forth furthermore makes it easy to quickly exchange a magazine if, for some reason, a fault should occur in it.

Even if the embodiment shown has been assumed to have two separate motors M1 and M2, it is possible to arrange a common driving motor, twofold discharge of notes or the like taking place after the magazine lying nearest to the common junction 01, and when a fault has been detected the whole bundle of notes is rejected and taken to magazine 60.

The apparatus is of course not limited to be used for banknotes only but also for entrance tickets, lottery tickets and the like.

We claim:

1. An apparatus for discharging banknotes or the like, said apparatus having a dispensing aperture accessible to customers from the apparatus exterior, a number of banknote magazines within said apparatus, feeding means for feeding banknotes from said magazines to the dispensing aperture, detector and counter means for detecting banknotes possibly fed out twofold and for counting dispensed banknotes, the improvement comprising: said feeding means comprising separate feeders operatively associated with respective magazines, means for incorporating said separate feeders in a series banknote feeding path for banknotes from said magazine in common and along said series path toward a junction common to all said magazines and upstream of said dispensing aperture.

2. An apparatus as claimed in claim 1, wherein said separate feeders are in longitudinal alignment, and said apparatus comprises a first driving means for commonly driving said separate feeders and wherein said apparatus further comprises separate feeding means for feeding said banknotes from said common junction to a collecting room common to said banknotes and further to said dispensing aperture.

3. An apparatus as claimed in claim 2, characterized by detecting means arranged at each magazine for detecting notes possibly fed out twofold, said detecting means being arranged to stop said first driving means, at twofold discharge of notes, whereas said second driving means continues to drive the remaining part of the feeding means, whereby notes possibly lying between the common junction and the common collecting room are fed to the common collecting room.

4. An apparatus as claimed in claim 3, characterized by a control means in connection with the common junction, arranged in a first normal working position to steer notes from the common junction to the common collecting room, and in a second position caused by the detection of a twofold discharge of notes by any of the said detecting means, to steer notes from the common junction to a special magazine intended for collecting notes, whereby at a twofold discharge by one of the magazines, notes in the first part of the feeding means will be fed to the special magazine after the first driving means has been stopped because of the twofold discharge and subsequently restarted.

5. An apparatus as claimed in claim 3, characterized in that a counter means is arranged in connection to the common junction, for counting notes passing between the common junction and the common collecting room, said counter means being adapted to cause feeding impulses to the separate feeder of the appropriate magazine in response to the desired number of notes, whereby even for cases of twofold discharge of notes the right number of notes will be fed out from the magazine in question to the common collecting room.

6. An apparatus as claimed in claim 2, characterized in that the common collecting room has a pivotably arranged bottom, and between the common collecting room and the dispensing aperture there is arranged a control means which in a first position enables the passage of notes from the collecting room to the dispensing aperture, and in a second position compulsorily leads notes from the collecting room to the special magazine, the control means being first set in the intended position after notes have been collected in the common collecting room, and hereafter the said pivotably arranged bottom is turned from a generally horizontal position to a vertical position.

7. An apparatus as claimed in claim 1, wherein said magazines are oriented vertically and underlie said separate feeders such that the stack of banknotes therein extends in a direction at right angles to the direction of movement along said common feed path.

8. An apparatus as claimed in claim 1, characterized by a common collecting room intended for notes discharged from the magazines, and a detector means disposed between the common collecting room and the common junction for detecting notes discharged twofold, the detector means being arranged, on detection of twofold discharged notes, to steer the whole bundle of notes from the common collecting room to a special magazine, and to restart the discharging process for dispensing a number of banknotes desired by a customer.

* * * * *